US005584331A

United States Patent [19]

Lin

[11] Patent Number: 5,584,331

[45] Date of Patent: Dec. 17, 1996

[54] SHUTTER

[76] Inventor: Kuo-Chung Lin, No. 629, Pei An Road, Taipei, Taiwan

[21] Appl. No.: 564,431

[22] Filed: Nov. 29, 1995

[51] Int. Cl.[6] ..... E06B 9/30; E05D 15/06

[52] U.S. Cl. ..... 160/172; 160/33; 160/34; 160/188; 160/201

[58] Field of Search ..... 160/33, 34, 188, 160/201, 172 R

[56] References Cited

U.S. PATENT DOCUMENTS

| | | | |
|---|---|---|---|
| 2,874,771 | 2/1959 | Muhr | 160/33 |
| 3,008,519 | 11/1961 | Hawkins | 160/172 R X |
| 3,520,346 | 7/1970 | Green | 160/172 R X |
| 3,578,060 | 5/1971 | Spencer | 160/172 R |
| 4,324,284 | 4/1982 | Frei | 160/172 R |
| 4,444,243 | 4/1984 | Voney et al. | 160/172 R |
| 5,501,261 | 3/1996 | Peale | 160/172 R X |

*Primary Examiner*—Blair Johnson
*Assistant Examiner*—Bruce A. Lev
*Attorney, Agent, or Firm*—Bacon & Thomas

[57] ABSTRACT

A shutter including a casing, two chain transmission mechanisms bilaterally and vertically mounted inside said casing, two linkages suspended from the top rail of the casing on the inside, a set of louvers pivotably connected between the linkages, a power drive controlled to turn the chain transmission mechanisms, and two hook members fastened to the chain transmission mechanisms and moved to carry the linkages and the louvers between the active position and the inactive position, louvers being carried turned between the horizontal position and the vertical position when the linkages are moved to the active position and the chain transmission mechanisms are continuously turned to a certain extent.

7 Claims, 7 Drawing Sheets

SHUTTER

BACKGROUND OF THE INVENTION

The present invention relates to shutters, and relates more particularly to such a shutter in which the louvers can be turned between the horizontal position and the vertical position to regulate light passing through, and can be also lifted and gathered together in the inactive position.

Regular shutters generally comprises a casing, a plurality of louvers transversely mounted inside the casing and turned between the horizontal position and the vertical position to regulate light passing through. However, because the louvers are not collapsible, the field of sight is obstructed.

SUMMARY OF THE INVENTION

It is one object of the present invention to provide a shutter which permits the louvers to be lifted to the top rail of the casing and gathered together. It is another object of the present invention to provide a shutter which can be operated automatically. It is still another object of the present invention to provide a shutter which can be controlled by a remote controller. According to one aspect of the present invention, the shutter comprises a casing, two chain transmission mechanisms bilaterally and vertically mounted inside said casing, two linkages suspended from the top rail of the casing on the inside, a set of louvers pivotably connected between the linkages, a power drive controlled to turn the chain transmission mechanisms, and two hook members fastened to the chain transmission mechanisms and moved to carry the linkages and the louvers between the active position and the inactive position, louvers being carried turned between the horizontal position and the vertical position when the linkages are moved to the active position and the chain transmission mechanisms are continuously turned to a certain extent. According to another aspect of the present invention, the power drive can be a reversible motor controlled by a motor controller to turn the chain transmission mechanisms. According to still another aspect of the present invention, the power drive can be a ratchet wheel mechanism turned by crank handle means.

BRIEF DESCRIPTION OF THE DRAWINGS

FIG. 6A is similar to FIG. 5B but showing the louvers fully closed;

DETAILED DESCRIPTION OF THE PREFERRED EMBODIMENTS

Figure 1:
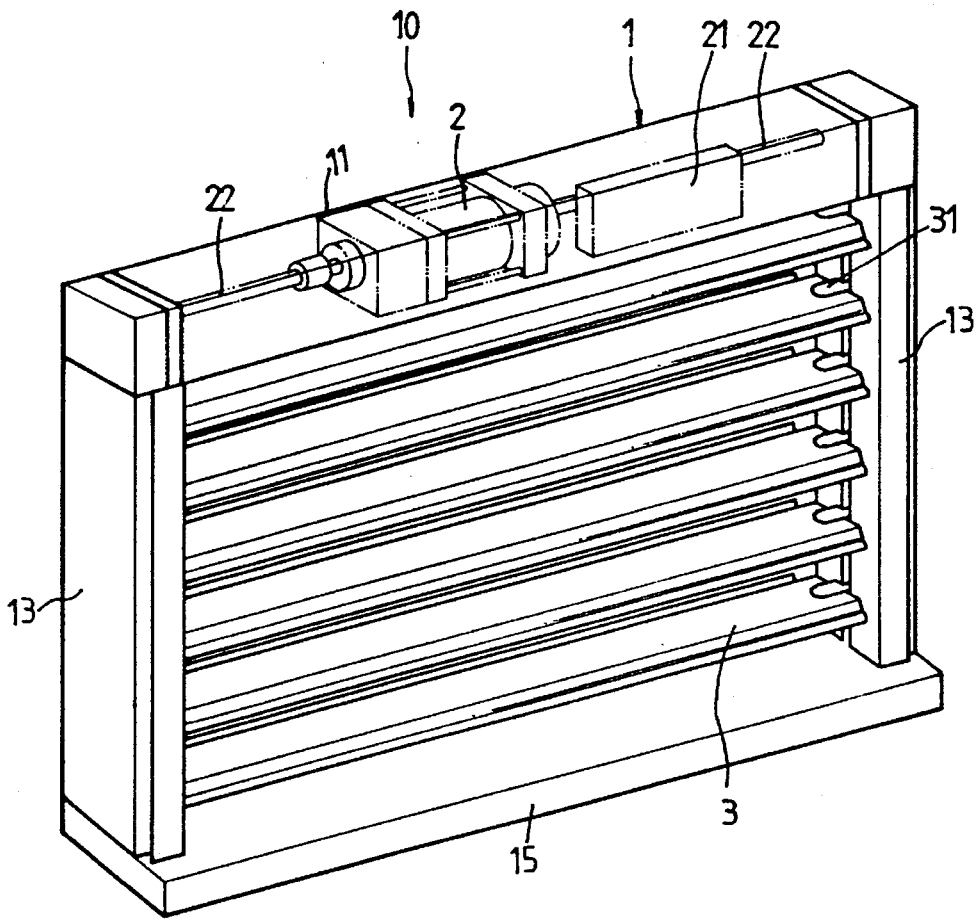
FIG. 1 is an elevational view of a shutter according to the present invention.
Figure 3:
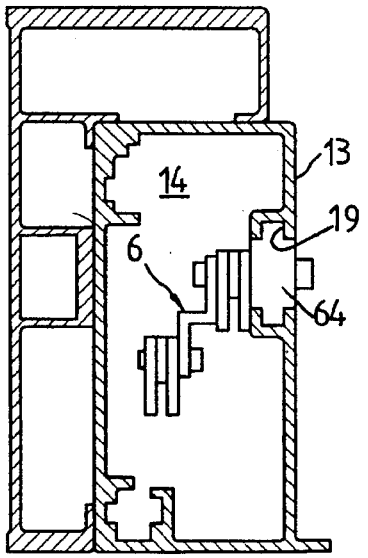
FIG. 3 a sectional view taken along line 3—3 of FIG. 5B.
Figure 2:
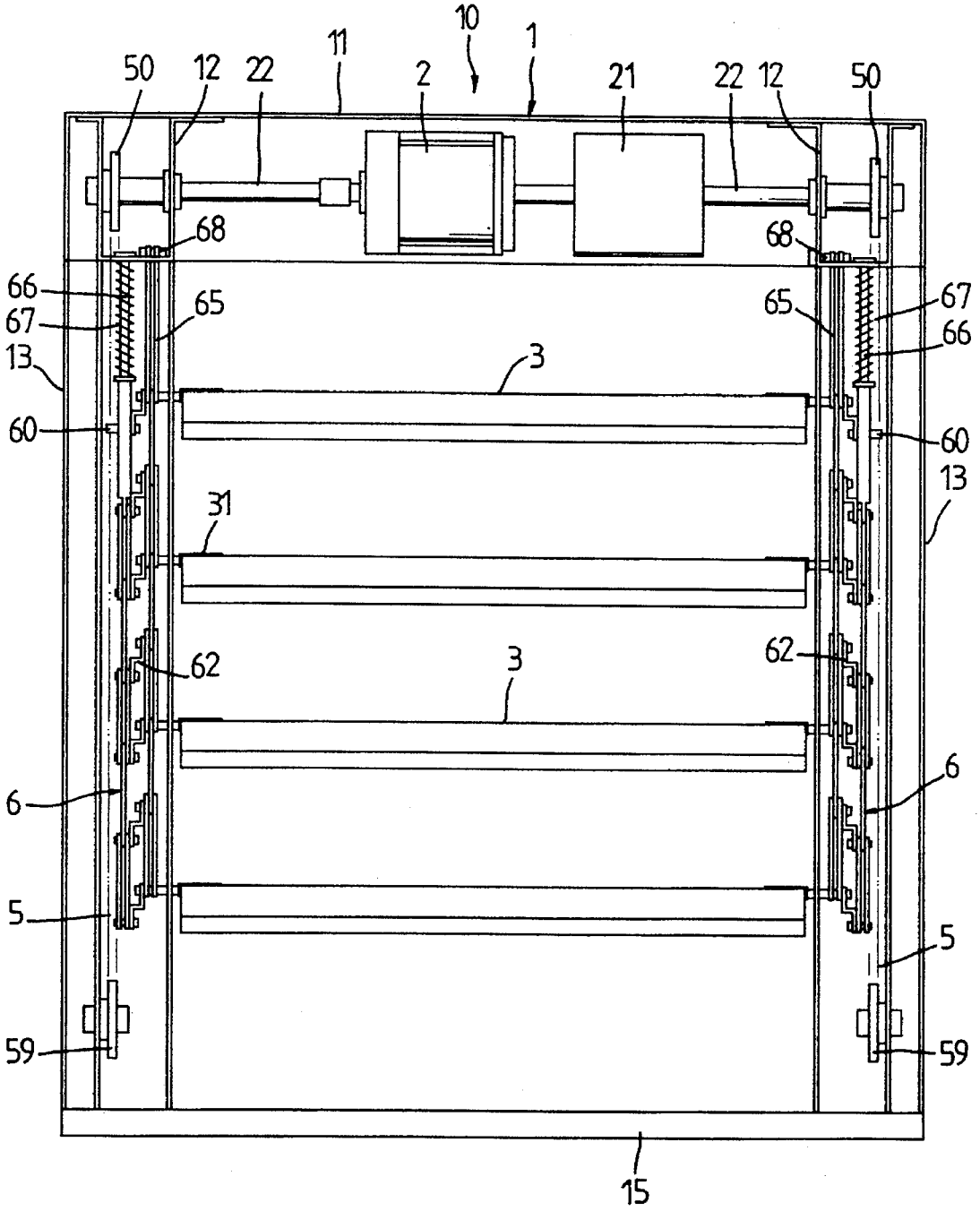
FIG. 2 is a sectional view of the shutter shown in FIG. 1.

Referring to FIGS. 1 and 2, the shutter, referenced by 10, comprises a casing 1. The casing 1 is a rectangular open frame comprised of a top rail 11, two hollow side jambs 13, and a bottom rail 15. The top rail 11 is shaped like a channel bar. A reversible motor 2 and a motor controller 21 are mounted on the top rail 11 at an inner side and controlled to lift or turn a set of louvers 3 inside the casing 1. The motor controller 21 is a wired controller for controlling the operation of the reversible motor 2. Alternatively, a remote controller may be used for controlling the operation of the reversible motor 2. The output power of the motor shaft 22 is transmitted to two chain wheels 50 at two opposite ends of the top rail 11. The chain wheels 50 are respectively supported on respective supports 12 at the top of each side jamb 13. The supports 12 are covered within the channel-like top rail 11. Two chain wheels 59 are respectively mounted inside the hollow side jambs 13 near two opposite ends of the bottom rail 15. Two chains 5 are bilaterally mounted on the chain wheels 50 and 59 and respectively received within the longitudinal through hole 14 of each side jamb 13 (see also FIG. 3).

Figure 5A:
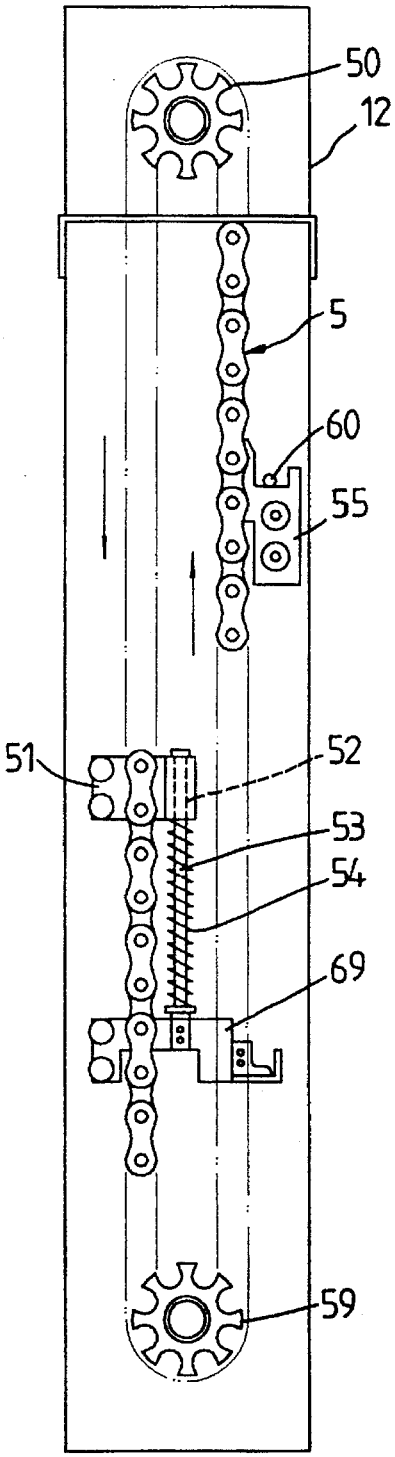
FIG. 5A is similar to FIG. 4A but showing the position of the chain transmission mechanism when linkages extended out.
Figure 5B:
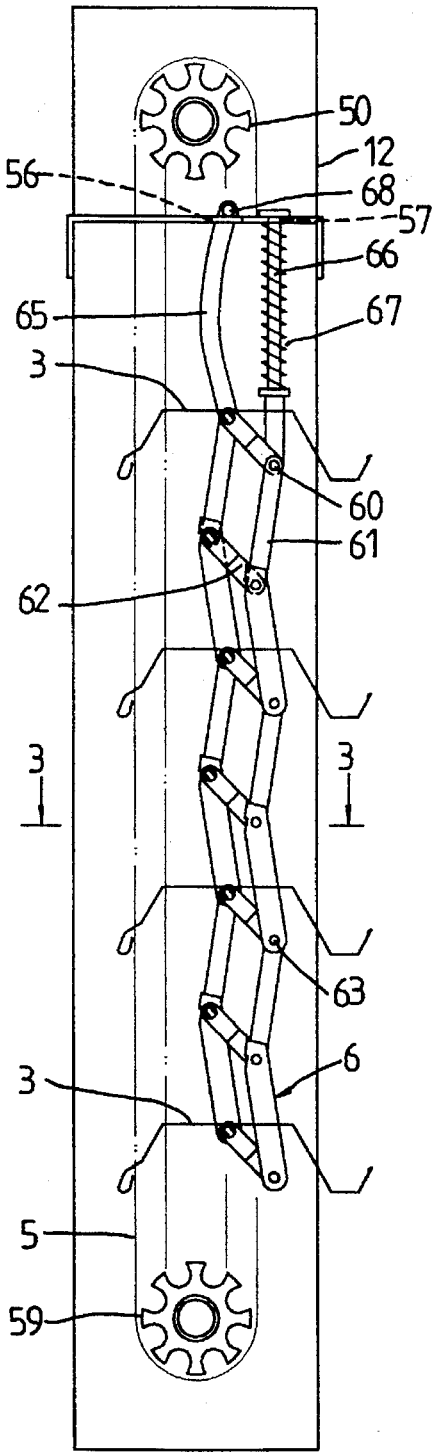
FIG. 5B is similar to FIG. 4B but showing linkages extended out.

Referring to FIGS. 5A and 5B and FIG. 2 again, two linkages 6 are respectively mounted inside the longitudinal through holes 14 of the hollow side jambs 13. Each of the linkage 6 comprises pairs of side-plates 61, a plurality of connecting rods 62 connected between the side-plates 61 by pivots 63 (the side-plates 61 and the connecting rods 62 form into a series of links respectively turned about the pivots 63). The two opposite ends of each of the louvers 3 are respectively fastened to the linkages 6 by a respective spring clamp fastener 31. The spring clamp fastener 31 has one end connected to one louver 3 and an opposite end connected to one pivot point 60 on one linkage 6.

Referring to FIGS. 5A and 5B, the linkages 6 are respectively suspended from the supports 12 by a respective smoothly arched suspension arm 65. The smoothly arched suspension arm 65 has a bottom end connected to one linkage 6, and a top end inserted through a respective through hole 56 on one support 12 and then coupled with a stopper 68. Two sets of sliding blocks 64 are respectively pivoted to the linkages 6, and moved in a respective sliding groove 19 inside each side jamb 13 (see also FIG. 3) to guide the linkages 6 between the active position and the inactive position. Two vertical rods 66 are movably inserted through a respective through hole 57 on each support 12 and coupled to the linkages 6. Two compression springs 67 are respectively mounted around the vertical rods 66 and stopped between the linkages 6 and the supports 12 to impart a downward pressure to the vertical rods 66 and the linkages 6 (this will be described further).

Figure 4A:
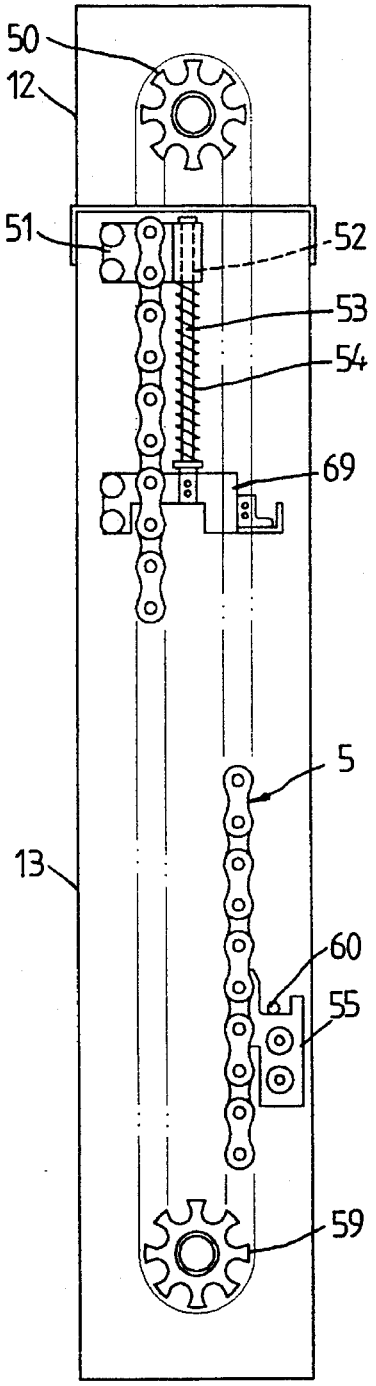
FIG. 4A is a side view of the shutter shown in FIG. 1, showing the position of the chain transmission mechanism when the louvers lifted.
Figure 4B:
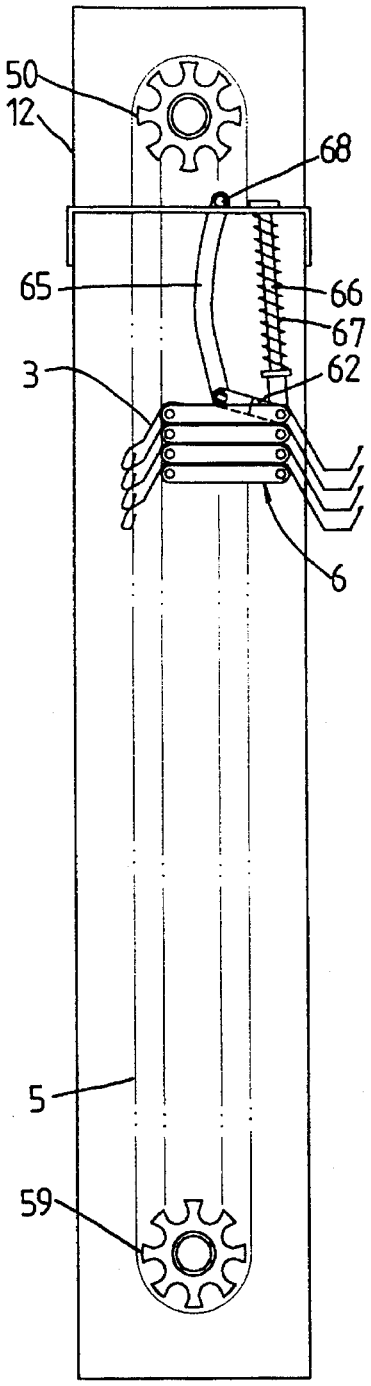
FIG. 4B is another side view of the shutter shown in FIG. 1, showing the louvers lifted and gathered together.

Referring to FIGS. 4A and 4B, a respective bracket 51 is fastened to each chain 5. The bracket 51 has a through hole 52 for passing a connecting rod 53. The connecting rod 53 has a bottom end connected to a frame 69 on one linkage 6. When the chain 5 is rotated, the bracket 51 is moved along the connecting rod 53. A pressure spring 54 is mounted around the connecting rod 53, having two opposite ends respectively connected to the bracket 51 and the frame 69 of the respective linkage 6. A respective hook member 55 is fastened to each chain 55 at a suitable location. When the chain 5 is rotated, the hook member 55 is moved to hook one pivot 60 of the respective linkage 6 and then to move the respective vertical rod 66 upwards, causing the louvers 3 to change their angular positions. The working distance of the springs 54 and 67 permits the louvers 3 to be turned from the fully open position (horizontal position) to the fully close position (vertical position).

Figure 6A:
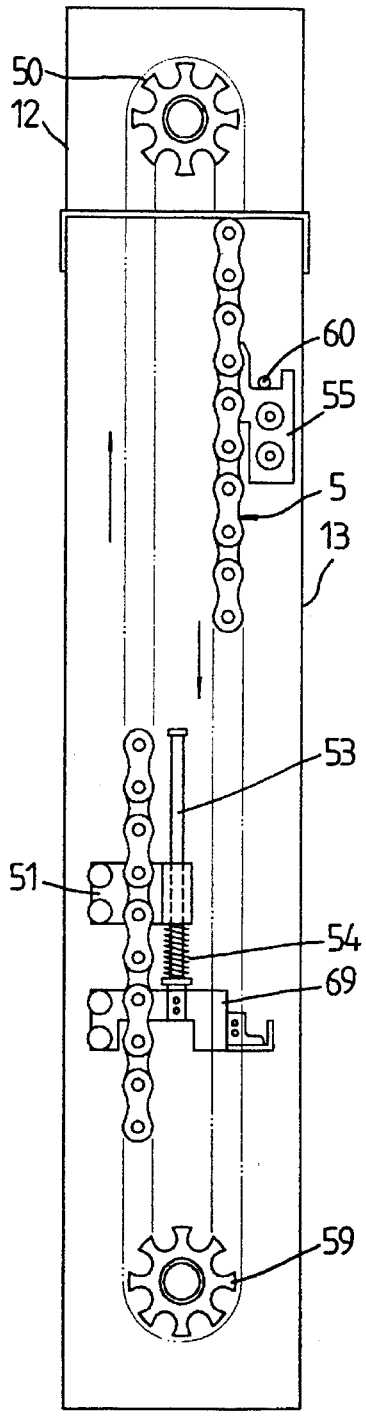
FIG. 6A is similar to FIG. 5A but showing the position of the chain transmission mechanism when the louvers fully closed.
Figure 6B:
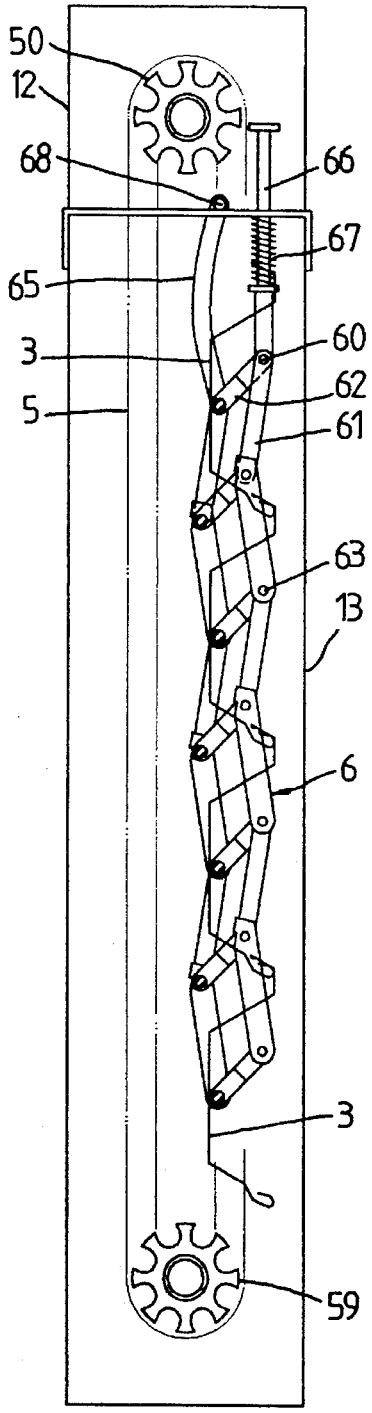

The operation of the present invention is outlined hereinafter. When the reversible motor 2 is turned in one direction by means of the control of the motor controller 21, the linkages 6 are retracted, the louvers 3 are gathered together, and the brackets 51 are stopped at the upper limit position (see FIGS. 4A and 4B). When the reversible motor 2 is turned in the reversed direction by means of the control of the motor controller 21, the chain 5 is rotated in the direction shown in FIG. 5A to release the linkages 6, and the linkages 6 are lowered. When the frames 69 are moved to the lower limit position as shown in FIG. 5A, the louvers 3 are extended out as shown in FIG. 5B. If the top switch is depressed after the louvers 3 are fully extended out, the chains 5 are continuously rotated, causing the brackets 51 to compress the springs 54 respectively (see FIG. 6A). At the same time, the hook members 55 of the chains 5 are forced to carry a respective pivot 60 upwards, causing the vertical rods 66 to compress the respective springs 67 (see FIG. 6B), and therefore the linkages 6 are forced to make a relative movement, i.e., one side of each linkage 6 is pulled upwards by the respective vertical rod 66 and the opposite side of each linkage 6 is pulled downwards. When the two opposite sides of each linkage 6 are moved in the reversed directions, the louvers 3 are turned about the respective pivots 60 from the fully open position to the fully close position (see FIG. 6B). When the lift control switch is switched on, the motor 2 is driven to rotate the chains 5 in the direction shown in FIG. 6A, and therefore the hook members 55 are lowered to release the springs 67. When the springs 67 are released, the vertical rods 66 are moved downwards to act against one side of each linkage 6, and therefore the louvers 3 are turned from the fully close position to the fully open position, and at the same time the springs 54 are returned to their former shapes as shown in FIG. 5B. If the motor 2 is continuously operated after the louvers 3 are turned to the fully open position, the frames 69 are moved upwards, causing the louvers 3 carried upwards and gathered together until the brackets 51 are moved to the upper limit position as shown in FIG. 4B.

Figure 7:
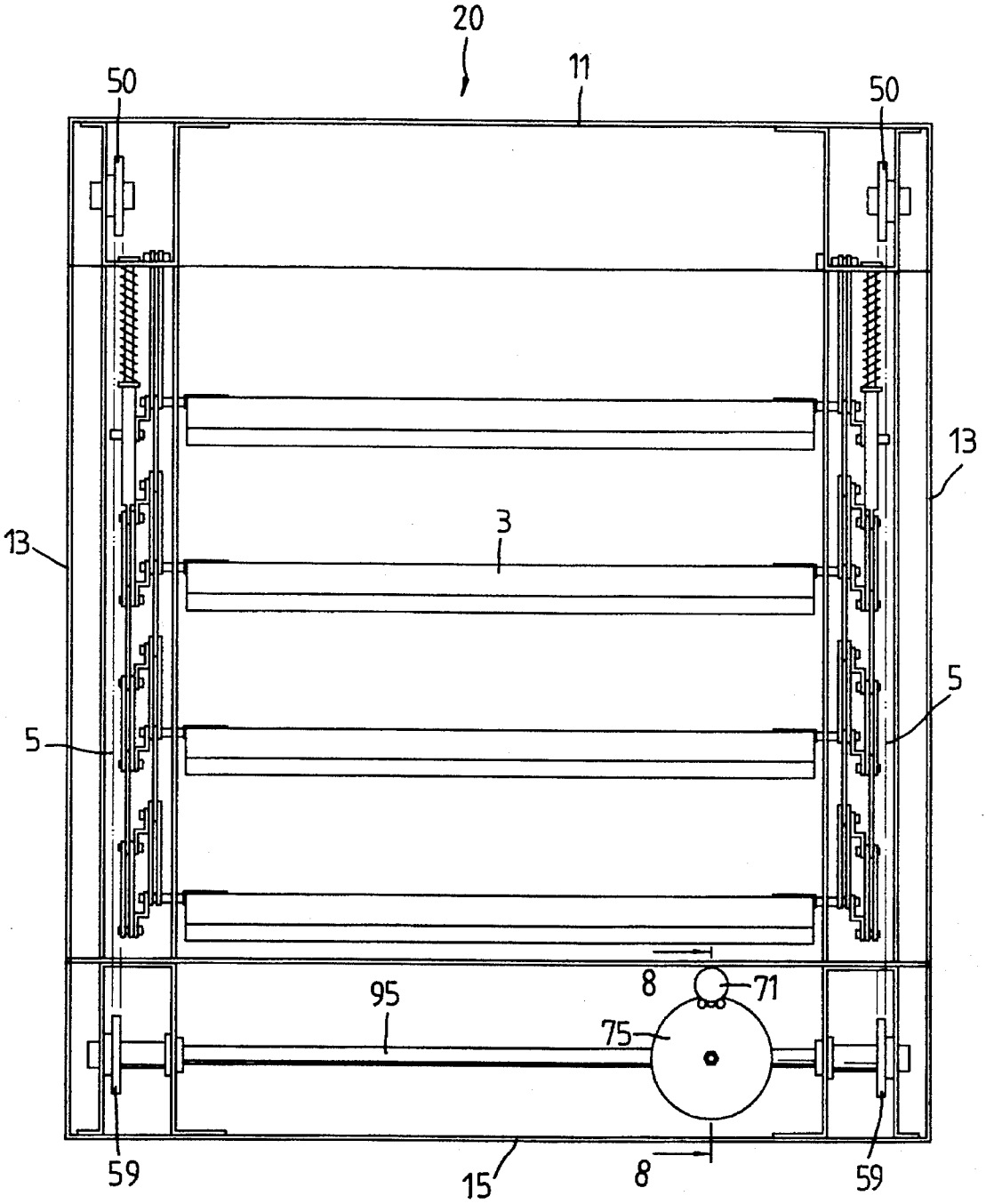
FIG. 7 is a front view of an alternate form of the present invention.
Figure 8:
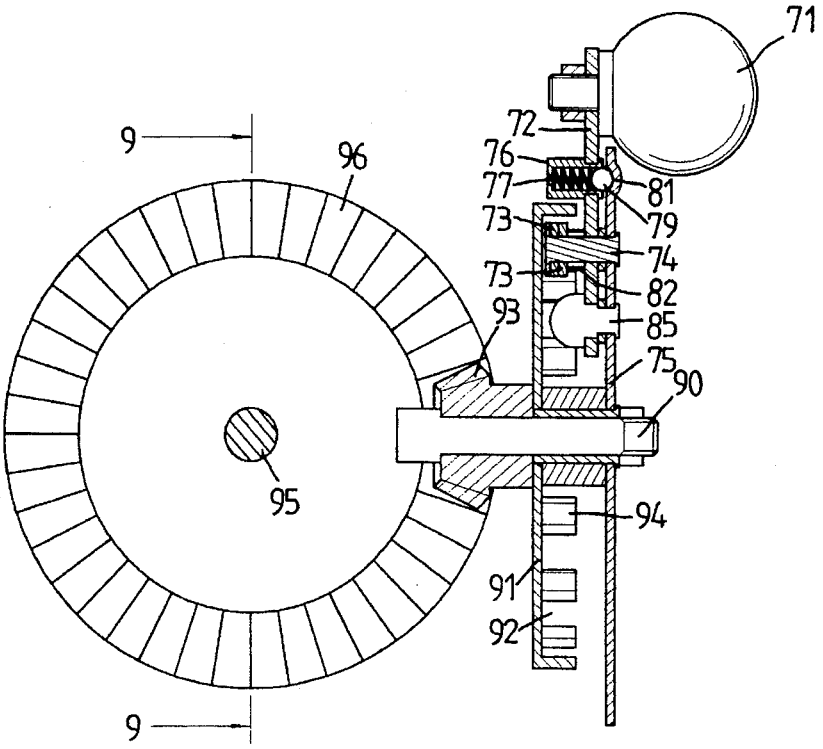
FIG. 8 is a sectional view taken along line 8—8 of FIG. 7.
Figure 9:
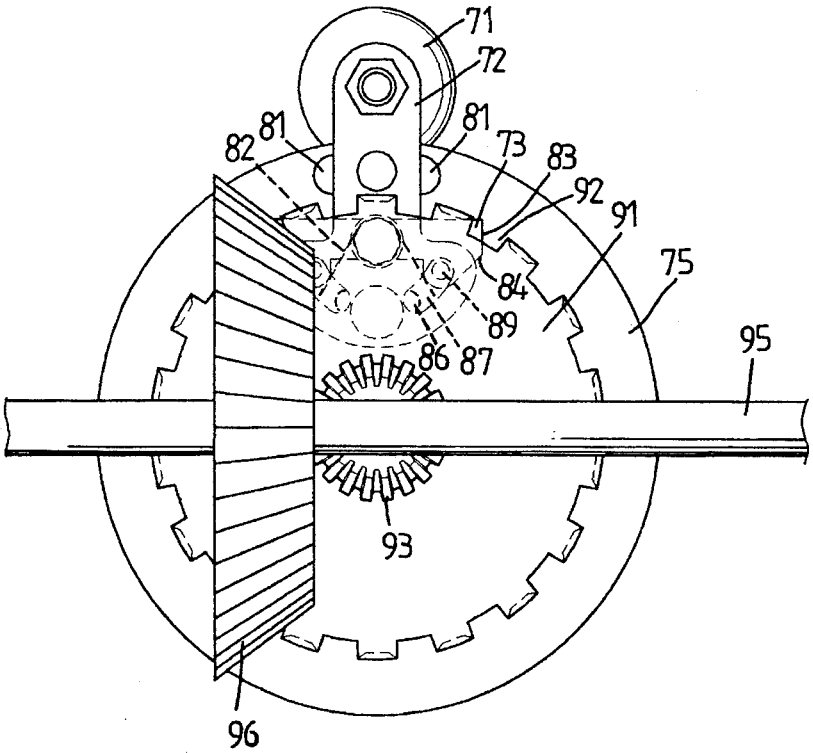
FIG. 9 is a sectional view taken along line 9—9 of FIG. 8.

FIGS. 7, 8, and 9 show an alternate form of the present invention, in which a ratchet wheel mechanism 7 is used and installed to replace the aforesaid reversible motor 2 and motor controller 21. This shutter, referenced by 20, is manually operated. As shown in FIGS. 8 and 9, the ratchet wheel mechanism 7 comprises a knob 71 perpendicularly connected to an arm 72. The arm 72 is pivoted to a rotary wheel 75 by a pivot 74. Two pawls 73 are coupled to the pivot 74. A socket 76 is mounted on the arm 72 to hold a compression spring 77 and a steel ball 79 on the compression spring 77. When the knob 71 is turned, the arm 72 and the pawls 73 are turned about the pivot 74 until the steel ball 79 is forced into one recess 81 on the rotary wheel 75. When the steel ball 79 is forced into one recess 81, the arm 72 is fixed to the rotary wheel 75, and the rotary wheel 75 can then be turned by the knob 71. The rotary wheel 75 has three recesses 81. When the steel ball 79 is forced into the middle recess 81, the pawls are maintained in horizontal and forced into engagement with a respective pitch 92 between two teeth 94 of the ratchet wheel, referenced by 91. The ratchet wheel 91 is fixed to the bottom rail 15. At this stage, the lateral side 83 of each pawl 73 is disposed in vertical, therefore the rotary wheel 75 is stopped from rotary motion and, the louvers 3 are respectively retained in position. When the arm 72 is fixed to the left or right recess 81, the pawls 73 are tilted, and only one pawl 73 is forced into engagement with the ratchet wheel 91. Because each of the pawls 73 has a slope 84, the rotary wheel 75 can be rotated by the knob 71 clockwise or counter-clockwise to move the linkages 6 when only one pawl 72 is forced into engagement with the ratchet wheel 91, so as to further move the louvers 3 to the active or inactive position, or to tilt the louvers 3. Two torsional springs 82 are respectively mounted on the pivot 74 to support the pawls 73, for permitting each pawl 73 to be shifted from one pitch 92 to another. There is also provided a stop pin 85 mounted on the arm 72 and moved in an arched guide slot 86 on the rotary wheel 75 to limit the angular displacement of the arm 72. The arm 72 further has two arched slots 87 at two opposite sides. The pawls 72 are respectively movably connected to the arched slots 87 by a respective pin 89. The rotary wheel 75 has a wheel shaft 90 at the center. A bevel gear 93 is fixedly mounted around the wheel shaft 90 and meshed with a bevel gear 96 on a transmission shaft 95. The transmission shaft 95 is mounted on the bottom rail 15, and driven to turn the chain wheels 59. When the transmission shaft 95 is rotated by the rotary wheel 95, the chain wheels 59 are driven to turn the chains 5, and therefore the linkages 6 are moved.

It is to be understood that the drawings are designed for purposes of illustration only, and are not intended as a definition of the limits and scope of the invention disclosed.

I claim:

1. A shutter comprising:

a casing made from a rectangular open frame comprised of a top rail, two hollow side jambs, and a bottom rail, each hollow side jamb having a support adjacent to said top rail;

two chain transmission mechanisms mounted inside said casing, each chain transmission mechanism comprising a first chain wheel mounted on the support of one hollow side jamb, a second chain wheel mounted on one hollow side jamb adjacent to said bottom rail, and a chain mounted on said first chain wheel and said second chain wheel;

two linkages respectively mounted inside said hollow side jambs, each linkage comprised of a set of links pivotably connected in series by pivots;

a plurality of louvers respectively connected between said linkages, said louvers being carried by said linkages between an inactive position and an active position, and turned by said linkages between a horizontal position and a vertical position when carried to said active position, each louver having two opposite ends respectively and pivotably connected to the links of said linkages by a respective spring clip fastener;

two smoothly arched suspension arms, each suspension arm having a bottom end connected to one linkage, and a top end inserted through a respective through hole on the support of one hollow side jamb and then coupled with a stopper;

two vertical rods movably inserted through a respective through hole on the support of each hollow side jamb and coupled to the linkages;

two compression springs respectively mounted around said vertical rods and stopped between said linkages and the supports of said hollow side jamb to impart a downward pressure to said vertical rods and said linkages;

two hook members respectively fixed to the chains of said chain transmission mechanisms, and moved by said chain transmission mechanism to carry said linkages and said louvers to said inactive position, or to release said linkages for permitting said linkages to be forced by said compression springs from said inactive position to said active position;

two brackets respectively fastened to the chains of said chain transmission mechanisms, each bracket having a through hole;

two connecting rods coupled between said brackets and said linkages, said connecting rod having a top end inserted through the through hole of one bracket and a bottom end coupled to a frame on one linkage;

two pressure springs respectively mounted around said connecting rods, each pressure spring having two opposite ends respectively connected to one bracket and the frame of the corresponding linkage; and a power drive controlled to turn said chain transmission mechanisms.

2. The shutter of claim 1 wherein said power drive comprises a reversible motor having a motor shaft respectively connected to the first chain wheel of each chain transmission mechanism, and a motor controller for controlling the operation of said reversible motor.

3. The shutter of claim 2 wherein said motor controller is a remote controller.

4. The shutter of claim 1 wherein each link of said linkages comprises two parallel side-plates, and a connecting rod connected between said side-plates by a pivot.

5. The shutter of claim 1 wherein each hollow side jamb comprises a longitudinal sliding groove, and a plurality of sliding blocks sliding in said longitudinal sliding groove and respectively coupled to one linkage.

6. The shutter of claim 1 wherein said power drive is a ratchet wheel mechanism turned by hand to rotate said chain transmission mechanisms.

7. The shutter of claim 6 wherein said ratchet wheel mechanism comprises:

a knob;

a rotary wheel having a wheel shaft at the center, a first recess, a second recess, and a third recess radially disposed around the border, and a curved guide slot, said second recess being disposed between said first recess and said third recess;

an arm having one end perpendicularly fixed to said knob and an opposite end pivoted to said rotary wheel by a pivot;

two pawls coupled to the pivot of said arm and supported on a respective torsional spring;

a socket mounted on said rotary wheel to hold a compression spring and a steel ball on the compression spring, and moved by said arm through said knob to force said steel ball into engagement with one recess of said rotary wheel;

a ratchet wheel fixedly secured to said bottom rail;

a stop pin mounted on said arm and moved in the curved guide slot of said rotary wheel to limit the angular displacement of said arm;

a first bevel gear fixedly mounted around the wheel shaft of said rotary wheel;

a transmission shaft revolvably mounted on said bottom rail and coupled to the second chain wheel of each linkage; and a second bevel gear fixedly mounted around said transmission shaft and meshed with said first bevel gear;

wherein when said steel ball is forced into said second recess in the middle, said pawls are maintained in horizontal and forced into engagement with said ratchet wheel to stop said rotary wheel from rotary motion; when said steel ball is forced into engagement with said first recess or said third recess, one pawl is forced into engagement with said ratchet wheel, for permitting said rotary wheel to be turned by said knob in one direction.

* * * * *